US010943755B2

(12) United States Patent
Su et al.

(10) Patent No.: US 10,943,755 B2
(45) Date of Patent: Mar. 9, 2021

(54) PROTECTION DEVICE

(71) Applicant: Polytronics Technology Corp., Hsinchu (TW)

(72) Inventors: Tsung Min Su, Hsinchu (TW); Chia Mao Chen, Ji'an Township, Hualien County (TW); David Shau Chew Wang, Taipei (TW)

(73) Assignee: Polytronics Technology Corp., Hsinchu (TW)

( * ) Notice: Subject to any disclaimer, the term of this patent is extended or adjusted under 35 U.S.C. 154(b) by 0 days.

(21) Appl. No.: 16/593,312

(22) Filed: Oct. 4, 2019

(65) Prior Publication Data

US 2020/0312600 A1 Oct. 1, 2020

(30) Foreign Application Priority Data

Apr. 1, 2019 (TW) ..... 10811144.1

(51) Int. Cl.
*H01H 85/175* (2006.01)
*H01H 37/76* (2006.01)
*H01H 85/00* (2006.01)

(52) U.S. Cl.
CPC ..... *H01H 85/175* (2013.01); *H01H 37/761* (2013.01); *H01H 85/0047* (2013.01); *H01H 2209/016* (2013.01)

(58) Field of Classification Search
CPC ..... H01H 85/175; H01H 2209/016; H01H 37/761; H01H 85/0047; H01H 37/34; H01H 2085/0283; H01M 2/34; H01M 2200/103; H01M 10/0525; H01M 2200/00; H01M 2220/20
USPC ..... 337/142, 182, 186, 202
See application file for complete search history.

(56) References Cited

U.S. PATENT DOCUMENTS

| | | | | |
|---|---|---|---|---|
| 10,109,439 | B2 * | 10/2018 | Komori | H01H 37/761 |
| 10,388,483 | B2 * | 8/2019 | Nan | H01H 85/175 |
| 2011/0012704 | A1 * | 1/2011 | Kimura | H01H 37/761 337/168 |
| 2012/0249283 | A1 * | 10/2012 | Kimura | H01H 37/761 337/416 |
| 2015/0044514 | A1 * | 2/2015 | Kimura | H01M 2/34 429/7 |
| 2015/0048922 | A1 * | 2/2015 | Kimura | H01H 85/003 337/401 |
| 2016/0013001 | A1 * | 1/2016 | Yoneda | H01H 85/11 337/227 |
| 2016/0372294 | A1 * | 12/2016 | Nan | H01H 85/175 |

FOREIGN PATENT DOCUMENTS

WO WO 2014/160664 A1 10/2014

* cited by examiner

*Primary Examiner* — Stephen S Sul
(74) *Attorney, Agent, or Firm* — Muncy, Geissler, Olds & Lowe, P.C.

(57) ABSTRACT

A protection device comprises a substrate, a fusible element, a flux and an insulating cover. The fusible element is disposed on the substrate and connects to a power line of an apparatus to be protected. The flux is disposed on the fusible element. The insulating cover is secured on the substrate to form a room for receiving the fusible element. The insulating cover has a bottom surface facing the substrate, and a plurality of protrusions are formed and distributed on the bottom surface to hold the flux in place.

9 Claims, 11 Drawing Sheets

PROTECTION DEVICE

BACKGROUND OF THE INVENTION

(1) Field of the Invention

The present application relates to a protection device applied to electronic apparatuses. More specifically, it relates to a protection device capable of preventing over-voltage, over-current and/or over-temperature.

(2) Description of the Related Art

Fuses containing low-melting metals, e.g., lead, tin or antimony, are well-known protection devices to cut off currents. To prevent over-current and over-voltage, various protection devices are continuously developed. For example, a device containing a substrate on which a heating layer and a low-melting metal layer are stacked in sequence. The heating layer heats up in the event of over-voltage, and then the heat is transferred upwards to the low-melting metal layer. As a result, the low-melting metal layer is melted and blown to sever currents flowing therethrough, so as to protect circuits or electronic apparatuses.

Recently, mobile apparatuses such as cellular phones and laptop computers are widely used, and people increasingly rely on such products over time. However, burnout or explosion of batteries of cellular phones or portable products during charging or discharging is often seen. Therefore, the manufacturers continuously improve the designs of over-current and over-voltage protection devices to prevent the batteries from being blown due to over-current or over-voltage during charging or discharging.

In a known protection device, the low-melting metal layer is in series connection to a power line of a battery, and the low-melting metal layer and a heating layer are electrically coupled to a switch and an integrated circuit (IC) device. When the IC device detects an over-voltage event, the IC device enables the switch to "on". As a result, current flows through the heating layer to generate heat to melt and blow the low-melting metal layer, so as to sever the power line to the battery for over-voltage protection. Moreover, it can be easily understood that the low-melting metal layer, e.g., fuses, can be heated and blown by a large amount of current in the event of over-current, and therefore over-current protection can be achieved also.

FIG. 1 shows a cross-sectional view of a known protection device. A protection device 10 comprises a substrate 11, a heating element 15, an insulating layer 16, a low-melting metal layer 13, a flux 19 and an insulating cover 14. FIG. 2 shows a bottom view of the insulating cover 14. The perimeter of the insulating cover 14 is disposed on the substrate 11 to provide an internal space to receive the low-melting metal layer 13 and the flux 19. The low-melting metal layer 13 connects to electrodes 12 at two sides and an intermediate electrode 17 in the middle. The insulating layer 16 covers the heating element 15. The low-melting metal layer 13 is disposed is above the insulating layer 16 to be fuses and is overlaid by the flux 19. As a result, the heating element 15 heats up to melt the low-melting metal layer 13, and then the low-melting metal layer 13 flows to the two electrodes 12 and the intermediate electrode 17 and therefore be blown to cut off current. To expedite and ensure effective blowout of the low-melting metal layer 13, the low-melting metal layer 13 is overlaid by flux 19 to prevent oxidation. An inner bottom surface 141 of the insulating cover 14 is provided with a circular ring 20 to confine the flux 19 on the center of the low-melting metal layer 13. However, the flux 19 is confined at the center by the circular ring 20 and the top of the flux 19 may go down due to gravity to leave a gap to the inner bottom surface 141 of the insulating cover 14. This causes insufficient flux 19 and therefore the low-melting metal layer 13 is not easily blown.

SUMMARY OF THE INVENTION

The present application provides a protection device for over-current, over-voltage and/or over-temperature protection. The insulating cover of the protection device has a bottom surface with protrusions. Gaps among the protrusions can absorb and accommodate sufficient flux on the fusible element by capillarity to ensure effective blowout of the fusible element.

In accordance with an embodiment of the present application, a protection device comprises a substrate, a fusible element, a flux and an insulating cover. The fusible element is disposed on the substrate and connects to a power line of an apparatus to be protected. The flux is disposed on the fusible element. The insulating cover is secured on the substrate to form a room for receiving the fusible element. The insulating cover has a bottom surface facing the substrate, and a plurality of protrusions are formed and distributed on the bottom surface to hold the flux in place.

In an embodiment, gaps among the protrusions absorb the flux by capillarity.

In an embodiment, an area covered by the protrusions exceeds one third of an area of the bottom surface of the insulating cover.

In an embodiment, the protrusion is shaped of a cylinder, an elliptic cylinder, a triangular prism, a square column, a hexagonal column or a cone.

In an embodiment, the protrusion has a wide top and a narrow bottom.

In an embodiment, the protrusion has a taper sidewall with an angle of 5-45 degrees.

In an embodiment, the protrusions at a center of the bottom surface of the insulating cover are shorter than the protrusions at a perimeter of the bottom surface of the insulating cover.

In an embodiment, the protrusions are distributed on the bottom surface of the insulating cover in an array.

In an embodiment, the protrusions are distributed at a polygonal center of the bottom surface of the insulating cover.

In an embodiment, the bottom surface of the insulating cover has a convex platform on which the protrusions are formed.

In accordance with the present application, the insulating cover of the protection device has a bottom surface with protrusions in column or cone shapes. The gaps among the protrusions increase storage amount of the flux by capillarity. Moreover, the protrusions are not limited to be disposed at the center and instead distributed on a large area to increase the amount of flux. The fusible element contracts after melting and as a result it would be heightened to touch the inner surface of the insulating cover which may be burned if containing plastic. The protrusions with different heights can resolve this issue. The protrusions without height differences may avoid the contact of the fusible element and the insulating cover during contraction after melting by reducing the heights of the protrusions. However, the fusible element may be not easily blown due to insufficient flux.

BRIEF DESCRIPTION OF THE DRAWINGS

The present application will be described according to the appended drawings in which.

DETAILED DESCRIPTION OF THE INVENTION

The making and using of the presently preferred illustrative embodiments are discussed in detail below. It should be appreciated, however, that the present application provides many applicable inventive concepts that can be embodied in a wide variety of specific contexts. The specific illustrative embodiments discussed are merely illustrative of specific ways to make and use the invention, and do not limit the scope of the invention.

Figure 1:
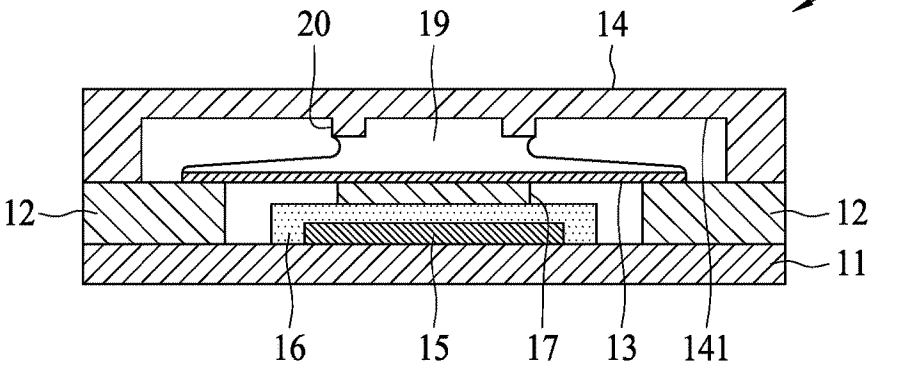
FIG. 1 (Prior Art)
FIG. 1 shows a known protection device.
Figure 2:
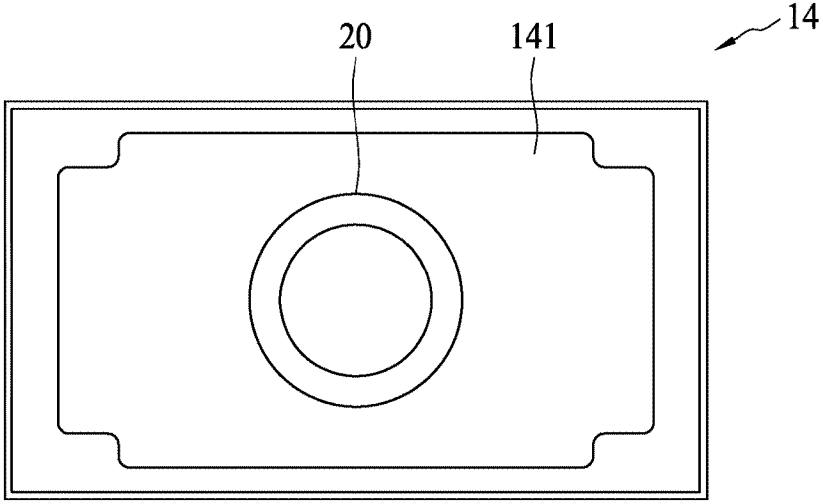
FIG. 2 (Prior Art)
FIG. 2 shows an insulating cover of the protection device of FIG. 1.
Figure 3A:
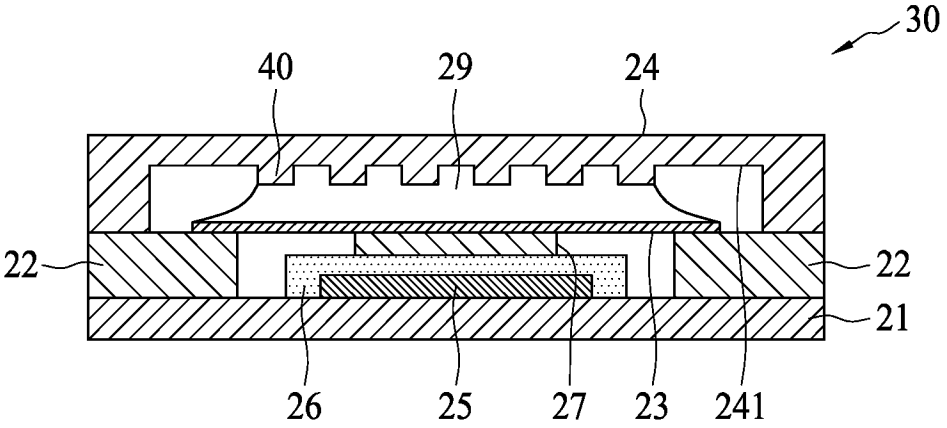
FIG. 3A shows a protection device in accordance with an embodiment of the present application.
Figure 3B:
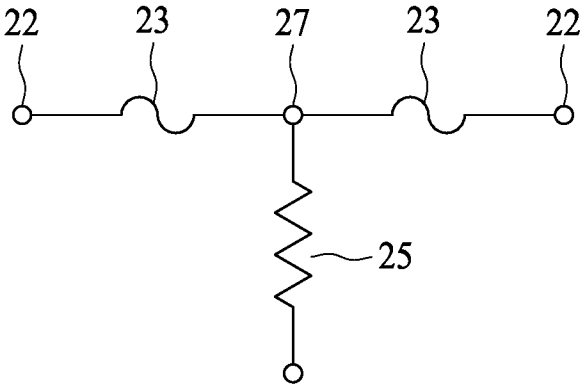
FIG. 3B shows a circuit diagram of the protection device of FIG. 3A.

FIG. 3A shows a protection device in accordance with an embodiment of the present application. The protection device 30 comprises a substrate 21, a heating element 25, an insulating layer 26, a fusible element 23, a flux 29 and an insulating cover 24. The insulating cover 24 is disposed on the substrate 21 to form a space to receive the heating element 25, the insulating layer 26, the fusible element 23 and the flux 29. The substrate 21 may be a planar ceramic substrate. The fusible element 23 is disposed on the substrate 21 and connects to a power line of an apparatus to be protected through electrode layers 22 at two ends. The fusible element 23 comprises low-melting metal which is melted in the event of over-current and is heated and blown in the event of over-voltage. The insulating layer 26 covers the heating element 25. The fusible element 23 is disposed on the insulating layer 26 to be fuses and is overlaid by the flux 29. The heating element 25 heats up to blow the fusible element 23, and the melted fusible element 23 flows to the electrode layers 22 and an intermediate electrode 27 and blows out to cutoff current for safety. To expedite and ensure effective blowout of the fusible element 23, the fusible element 23 is overlaid by the flux 29 to prevent oxidation. The insulating cover 24 has an inner bottom surface with a plurality of protrusions 40 to confine or hold the flux 29 in place or at a certain position. FIG. 3B shows an equivalent circuit diagram of the protection device 30, which is a fuse device with three terminals. The heating element 25 electrically connects to the fusible element 23 through the intermediate electrode 27, and thereby the fusible element 23 contains two fuses.

Figure 4:
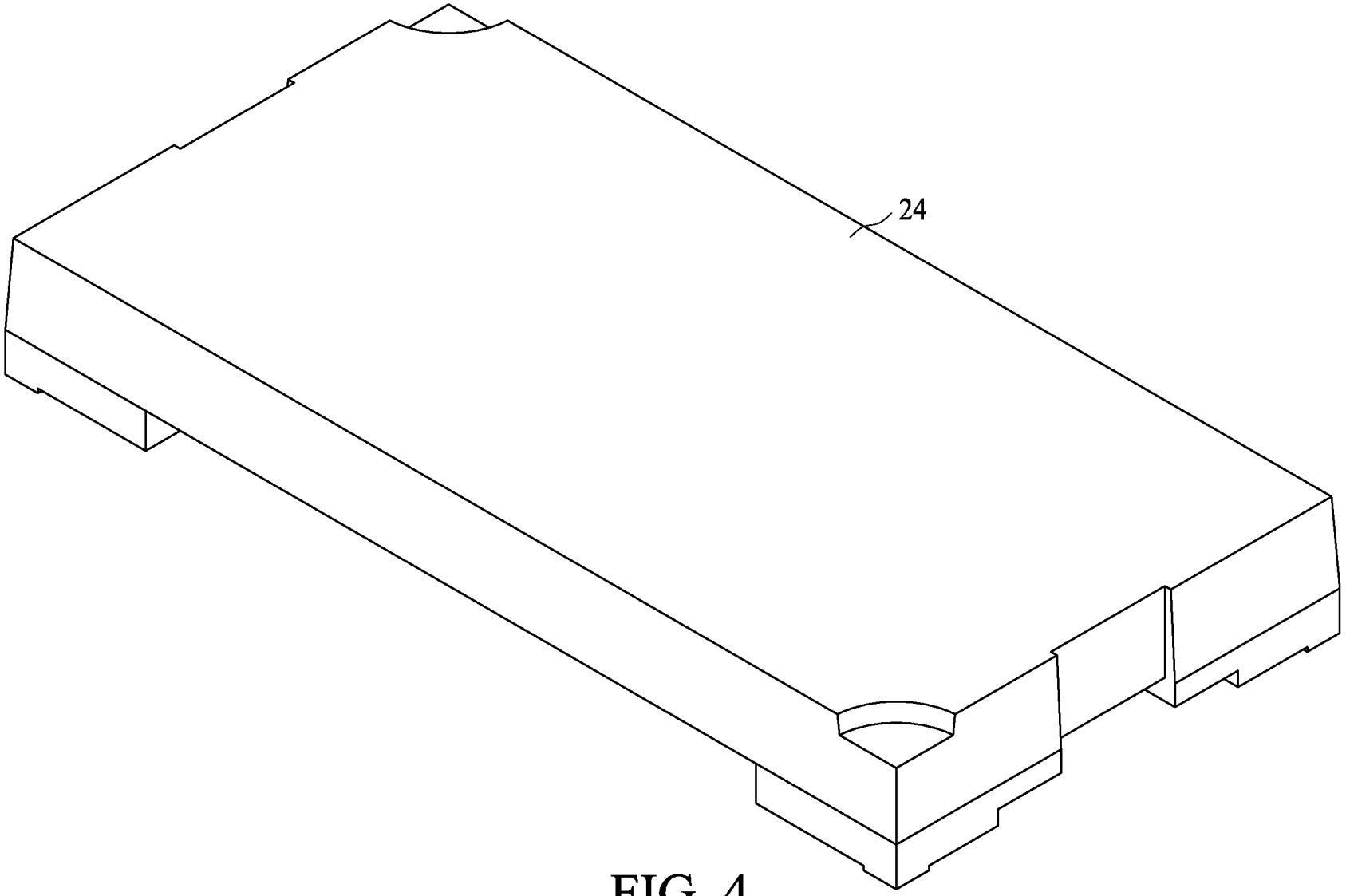
FIG. 4 shows a perspective view of the insulating cover of the protection device of FIG. 3A.

The present application devises a structure to confine the flux 29 at a certain position on an inner bottom surface 241 of the insulating cover 24 to increase the amount of the flux 29, so as to solve the problem that the fusible element 23 is not easily blown due to insufficient flux 29. FIG. 4 shows a perspective view of the insulating cover 24 in accordance with an embodiment of the present application. The insulating cover 24 is described in detail below.

Figure 5A:
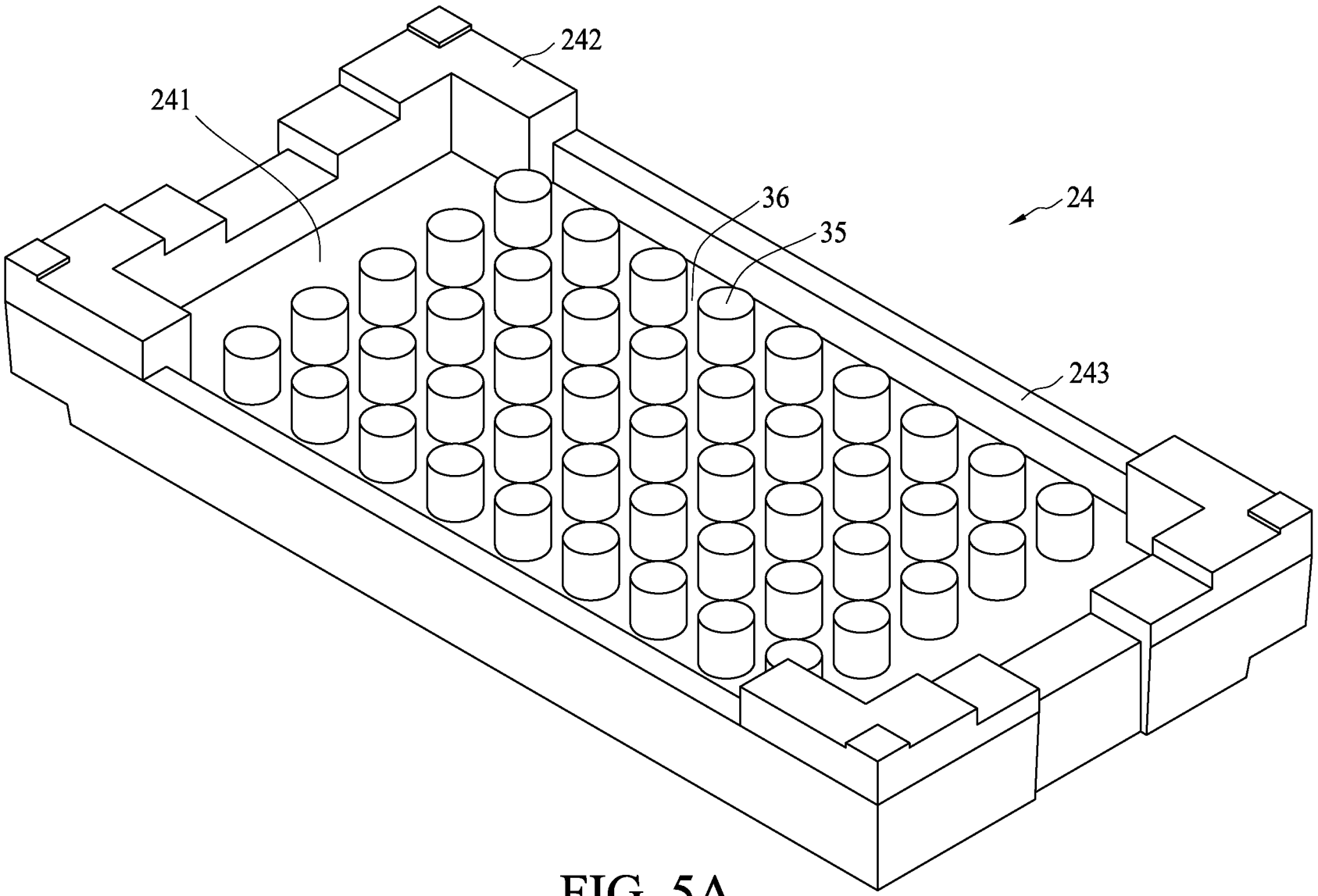
FIGS. 5A through 5D show an insulating cover of the protection device in accordance with an embodiment of the present application.
Figure 5C:
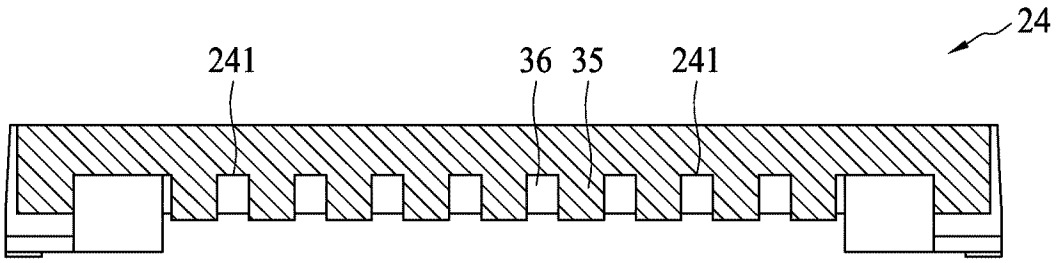
Figure 5D:
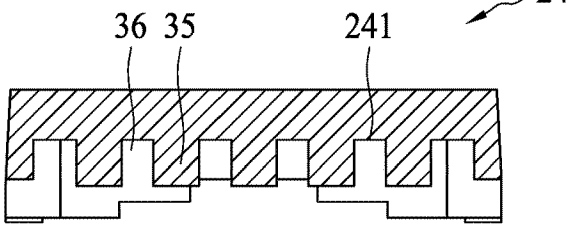
Figure 5B:
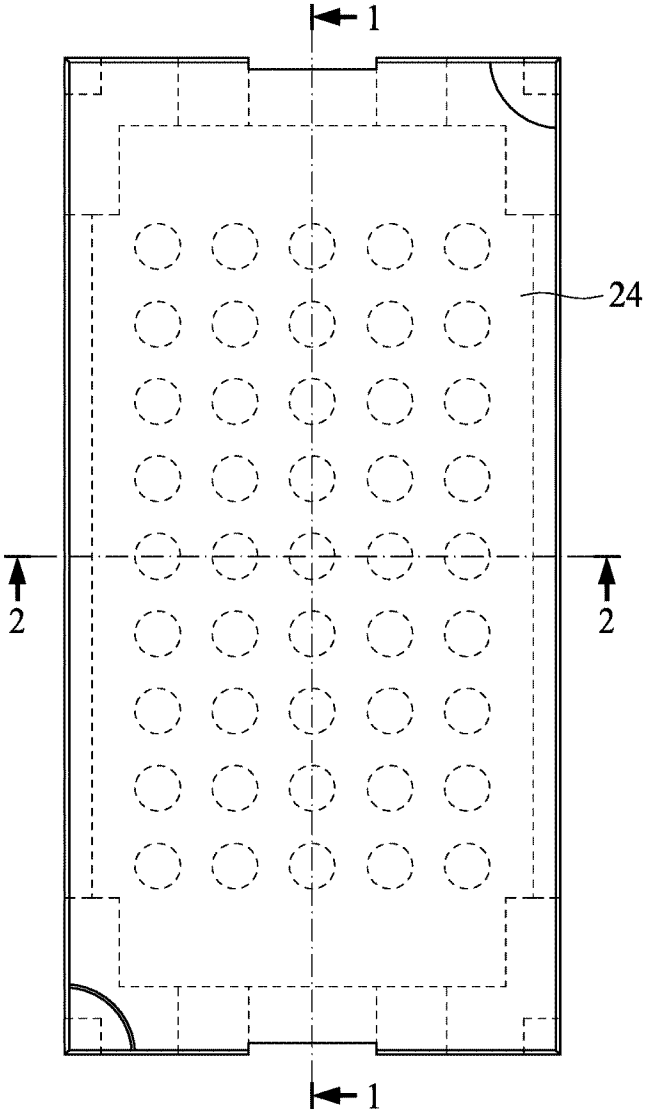

FIGS. 5A through 5D show the insulating cover 24 in accordance with an embodiment of the present application. FIG. 5A is a view of the insulating cover 24 upside down. FIG. 5B shows a top view of the insulating cover 24. FIG. 5C and FIG. 5D show cross-sectional views of line 1-1 and line 2-2 of FIG. 5B, respectively. A plurality of protrusions 35 are formed on a bottom surface 241 of the insulating cover 24. The protrusions 35 have the same heights and are distributed on the bottom surface 241 in an array. The gaps 36 among the protrusions 35 confine the flux 29 in place. The flux 29 goes into gaps 36 among adjacent protrusions 35 by capillarity to increase the amount of the flux 29. The corners of the insulating cover 24 have support blocks 242 to be connected to and secured to the substrate 21. The support blocks 242 and two sidewalls 243 form an inner space or a room.

Figure 5E:
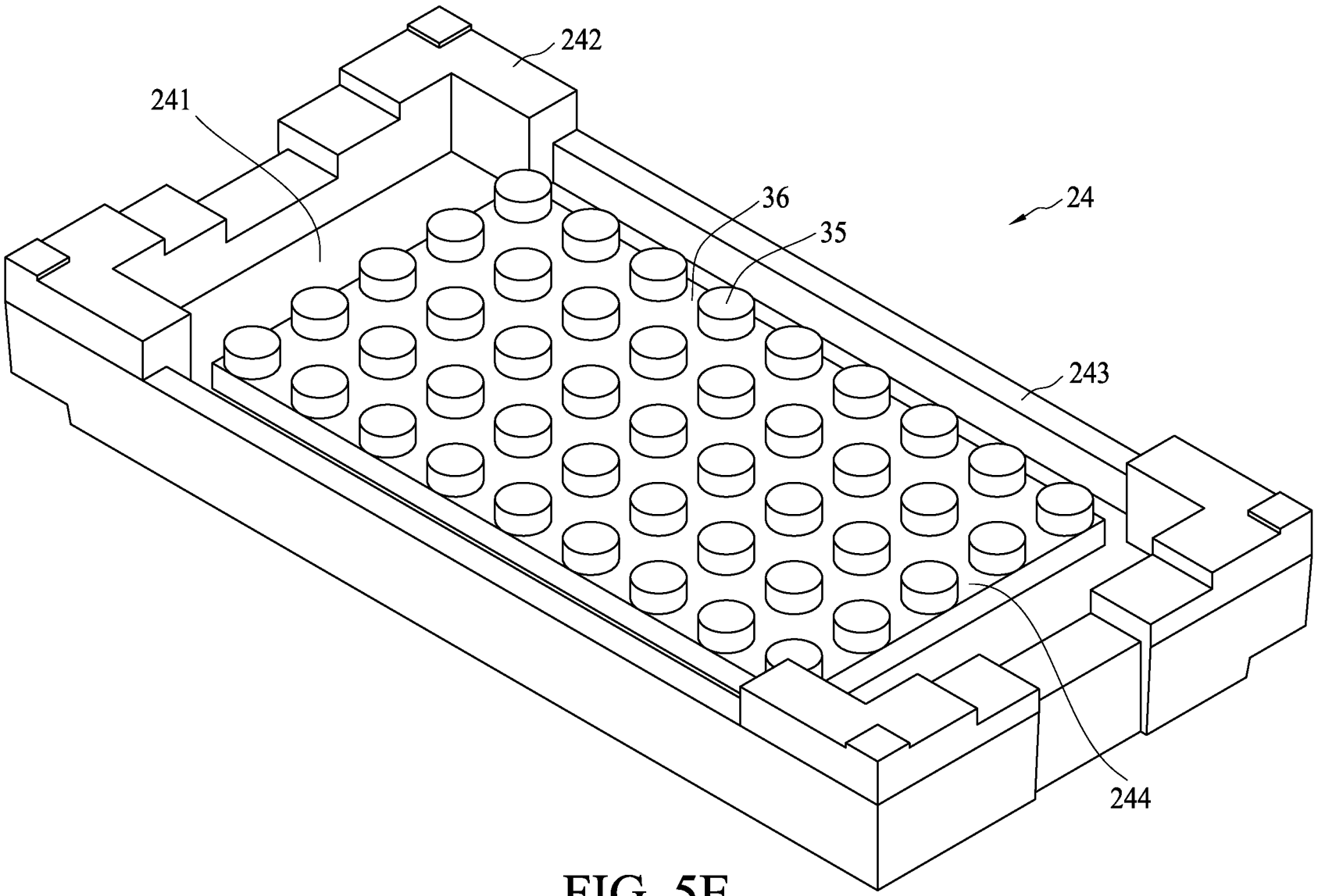
FIG. 5E shows an insulating cover of the protection device in accordance with another embodiment of the present application.

In FIG. 5E, a convex platform 244 is formed on the bottom surface 241 of the insulating cover 24. The protrusions 35 are distributed on the convex platform 244. As a result, short protrusions 35 may be made to facilitate mold release of the insulating cover 24 after injection molding. The protrusions 244 can carry a part of protrusions 35 or all protrusions 35 as desired. The convex platform 244 does not limited to be of a same thickness. For example, the convex platform 244 may have a thin center and a thick perimeter to accommodate more flux 29.

Figure 6A:
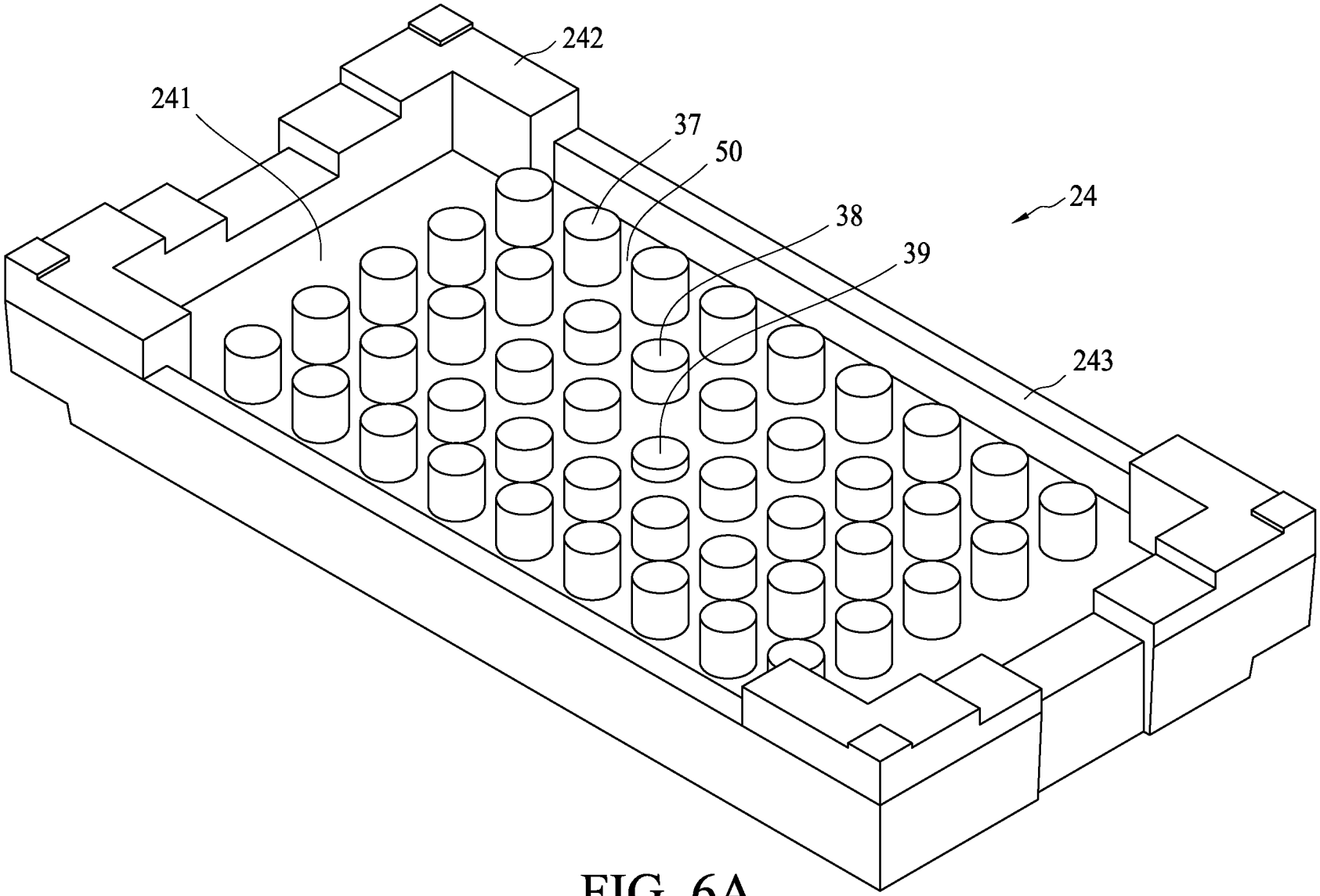
FIGS. 6A through 6D show an insulating cover of the protection device in accordance with yet another embodiment of the present application.
Figure 6C:
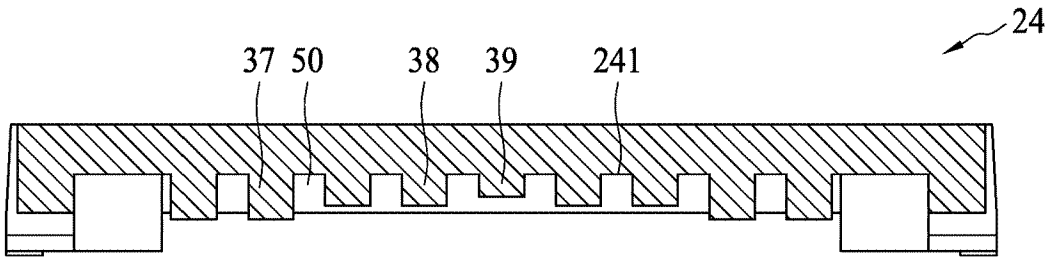
Figure 6D:
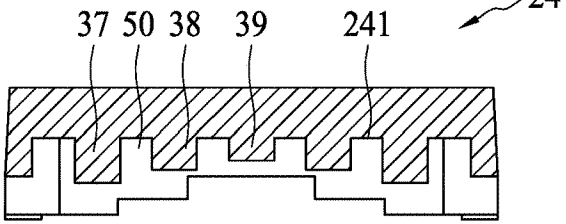
Figure 6B:
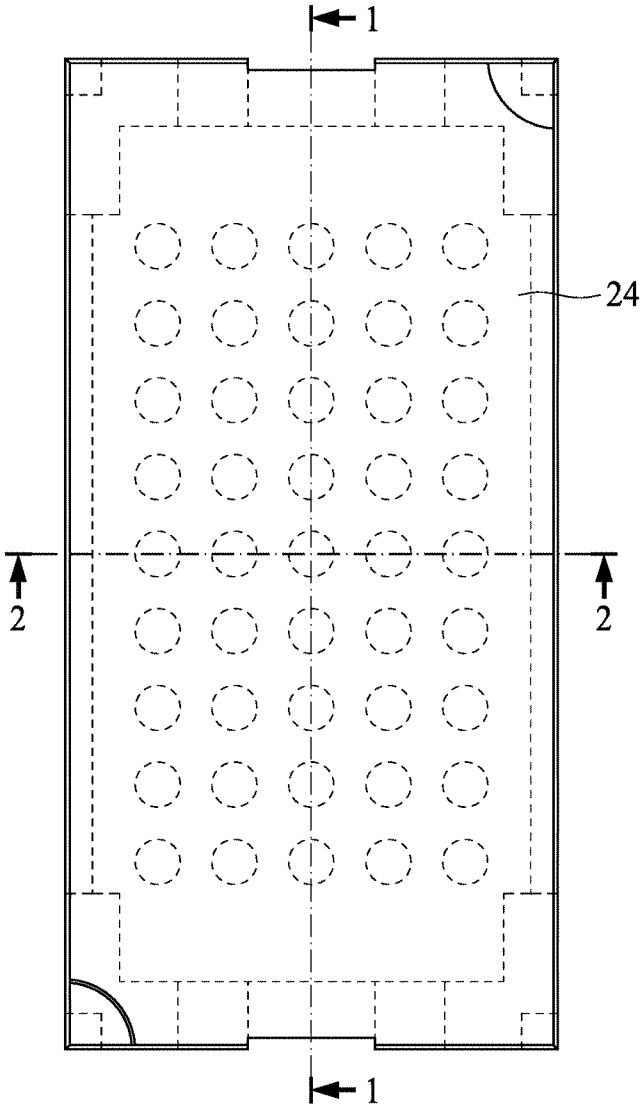

FIGS. 6A through 6D show the insulating cover 24 in accordance with another embodiment of the present application. FIG. 6A shows a view of an insulating cover 24 upside down. FIG. 6B shows a top view of the insulating cover 24. FIG. 6C and FIG. 6D show cross-sectional views of line 1-1 and line 2-2 of FIG. 6B, respectively. Protrusions 37, 38 and 39 are formed and distributed on a bottom surface 241 of the insulating cover 24. The gaps 50 among neighboring protrusions 37, 38 and 39 hold the flux 29 in place. Preferably, the flux 29 goes into gaps 50 among adjacent protrusions 37, 38 and 39 by capillarity to increase the amount of the flux 29. In comparison with the previous embodiment, the protrusions 37, 38 and 39 are not of same heights. The protrusion 39 at the center is shortest, the protrusions 38 adjacent to the protrusion 39 have intermediate heights and the protrusions 37 in the perimeter have longest heights. The height differences of the protrusions 37, 38 and 39 make the insulating cover 24 have a large room at the center to avoid the fusible element 23 to contact the insulating cover 24 if the melted fusible element 23 heightens in contraction. If the insulating cover 24 contains plastic, it may melt or flames. The corners of the insulating cover 24 have support blocks 242 to be connected to and secured to the substrate 21. The support blocks 242 and two sidewalls 243 form an inner space or a room.

Figure 7A:
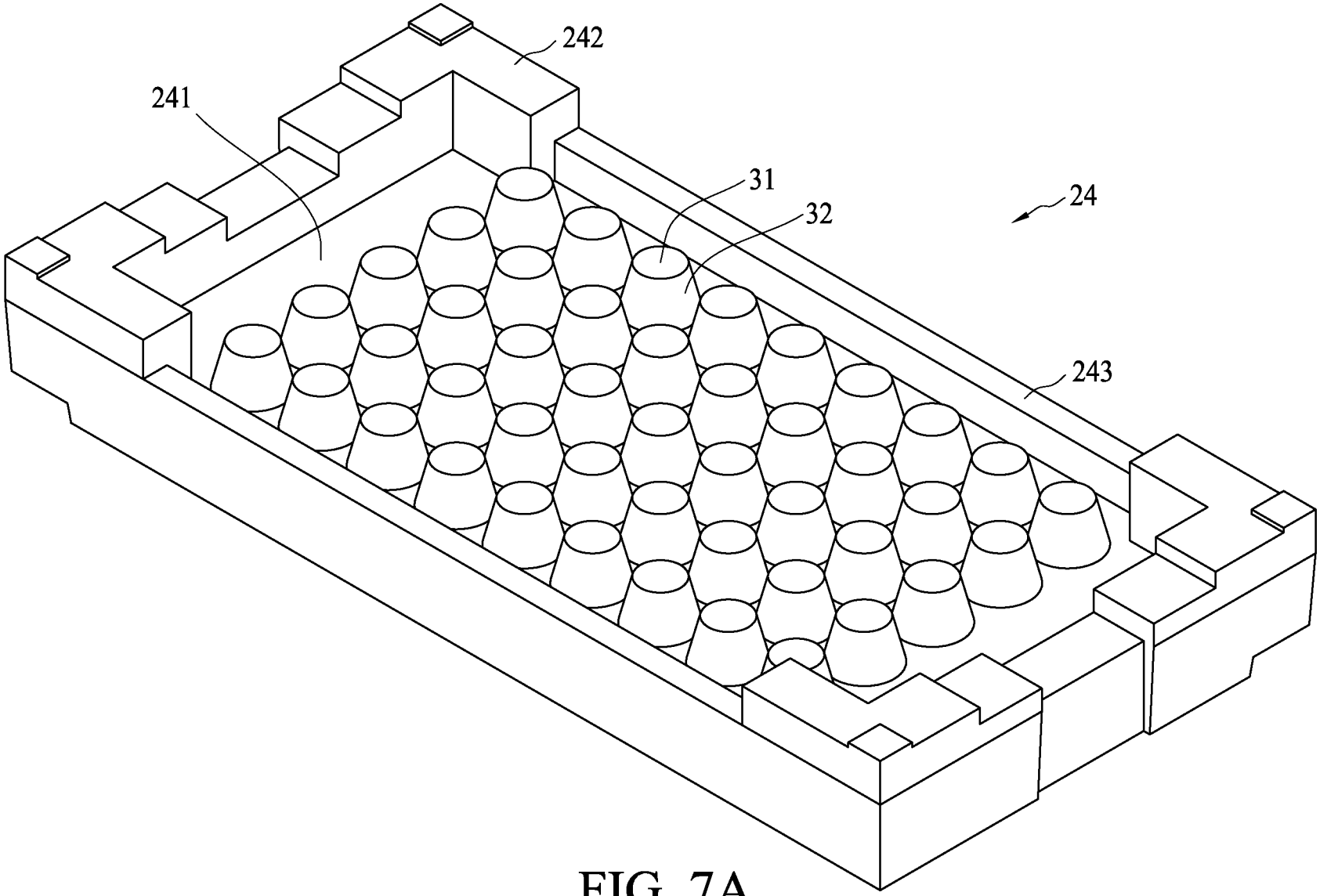
FIGS. 7A through 7D show an insulating cover of the protection device in accordance with still another embodiment of the present application.
Figure 7C:
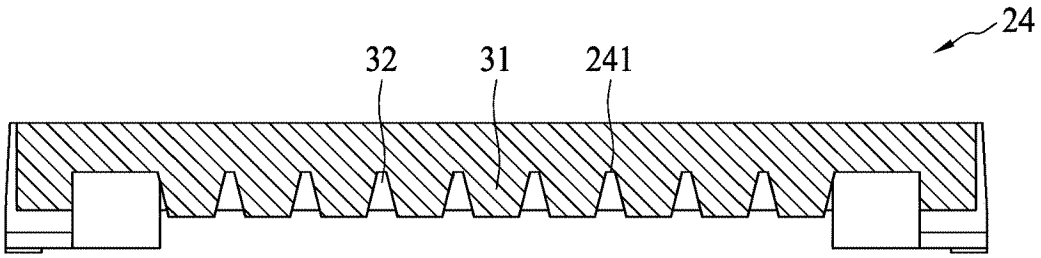
Figure 7D:
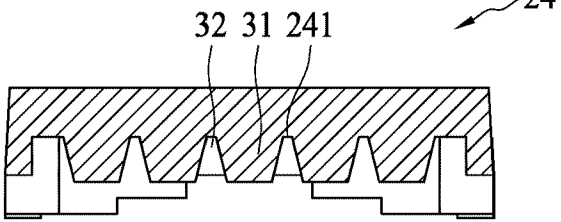
Figure 7B:
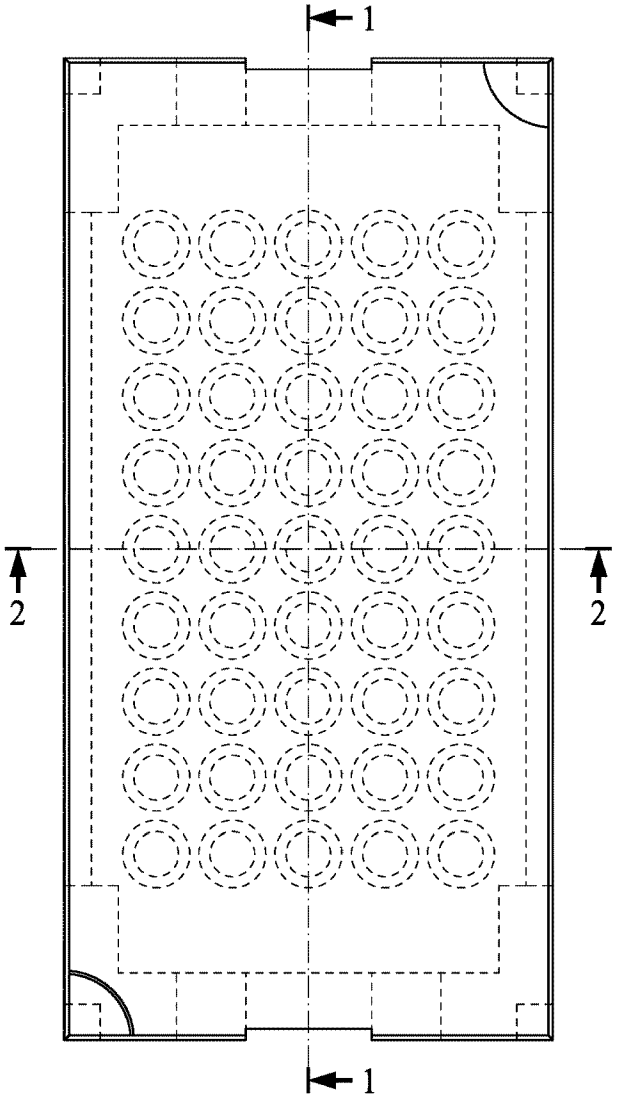

FIGS. 7A through 7D show the insulating cover 24 in accordance with yet another embodiment of the present application. FIG. 7A shows a perspective view of an insulating cover 24 upside down. FIG. 7B shows a top view of the insulating cover 24. FIG. 7C and FIG. 7D show cross-sectional views of line 1-1 and line 2-2 of FIG. 7B, respectively. Protrusions 31 are formed and distributed on a bottom surface 241 of the insulating cover 24. The gaps 32 among the protrusions 31 hold the flux 29 in place. Preferably, the flux 29 goes into gaps 32 by capillarity to increase the storage amount of the flux 29. The protrusions 31 are cylinders of a wide top and a narrow bottom. A taper sidewall of the protrusion 31 has an angle of 5 to 45 degrees, e.g., 10, 20 or 30 degrees. The corners of the insulating cover 24 have support blocks 242 to be connected to and secured to the substrate 21. The support blocks 242 and two sidewalls 243 form an inner space or room.

Figure 8:
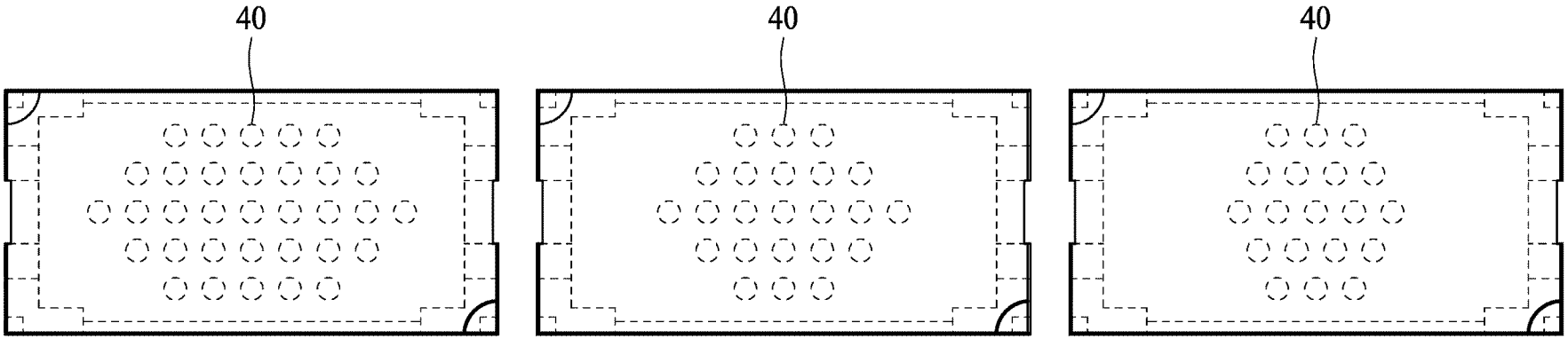
FIG. 8 shows embodiments of distribution of protrusions of the insulating cover in accordance with the present application.

FIG. 8 shows some distributions of the protrusions 40 of the insulating cover of the protection device of the present application. The protrusions 40 are distributed at a polygonal center of the bottom surface of the insulating cover. The distribution of the protrusions 40 are not limited to those shown in FIG. 8. In an embodiment, the distribution area of the protrusions is greater than ⅓ or ½ of the area of the bottom surface of the insulating cover to increase the storage amount of flux. If there is no protrusion or there are protrusions with low density at the center of the insulating cover, the distribution area of the protrusions should be increased. For example, the distribution area exceeds ⅔ area of the insulating cover to sustain enough flux.

In addition to a cylinder, the protrusion on the bottom surface of the insulating cover may be an elliptic cylinder, a triangular prism, a square column, a hexagonal column or a cone. The gaps among protrusions increase the storage amount of flux. The protrusions with different heights, e.g., shorter ones at the center and longer ones at the perimeter, can avoid the contact of the fusible element and the insulating cover if the melted fusible element heightens in contraction.

The above-described embodiments of the present invention are intended to be illustrative only. Numerous alternative embodiments may be devised by persons skilled in the art without departing from the scope of the following claims.

What is claimed is:

1. A protection device, comprising:

a substrate;

a fusible element disposed on the substrate;

a flux disposed on the fusible element; and an insulating cover secured to the substrate to form a room for receiving the fusible element, the insulating cover having a bottom surface facing the substrate, and a plurality of protrusions are formed and distributed on the bottom surface to hold the flux in place;

wherein the bottom surface of the insulating cover has a convex platform on which the plurality of protrusions are formed.

2. The protection device of claim 1, wherein gaps among the plurality of protrusions absorb the flux by capillarity.

3. The protection device of claim 1, wherein an area covered by the plurality of protrusions exceeds one third of an area of the bottom surface of the insulating cover.

4. The protection device of claim 1, wherein each of the plurality of protrusions is shaped of a cylinder, an elliptic cylinder, a triangular prism, a square column, a hexagonal column or a cone.

5. The protection device of claim 1, wherein each of the plurality of protrusions has a wide top and a narrow bottom.

6. The protection device of claim 1, wherein each of the plurality of protrusions has a taper sidewall with an angle of 5-45 degrees.

7. The protection device of claim 1, wherein the plurality of protrusions comprise protrusions at a center of the bottom surface of the insulating cover and protrusions at a perimeter of the bottom surface of the insulating cover, and the protrusions at the center of the bottom surface of the insulating cover are shorter than the protrusions at the perimeter of the bottom surface of the insulating cover.

8. The protection device of claim 1, wherein the plurality of protrusions are distributed on the bottom surface of the insulating cover in an array.

9. The protection device of claim 1, wherein the plurality of protrusions are distributed at a polygonal center of the bottom surface of the insulating cover.

* * * * *